United States Patent [19]

Bizilia

[11] Patent Number: 4,629,179

[45] Date of Patent: Dec. 16, 1986

[54] FOOT HOLDING APPARATUS FOR USE IN PERFORMING SIT-UP EXERCISES

[76] Inventor: George Bizilia, 89 Strathmore Rd., Brighton, Mass. 02139

[21] Appl. No.: 627,119

[22] Filed: Jul. 2, 1984

[51] Int. Cl.[4] ..... A63B 23/02

[52] U.S. Cl. ..... 272/93; 272/900

[58] Field of Search ..... 272/93, 96, 109, 145, 272/900; 128/25 B; 248/231.4, 231.8; 211/86

[56] References Cited

U.S. PATENT DOCUMENTS

| | | | |
|---|---|---|---|
| 3,134,592 | 5/1964 | Sharkey | 128/84 R |
| 3,917,261 | 11/1975 | Small et al. | 272/96 |
| 4,116,434 | 9/1978 | Bernstein | 272/93 |
| 4,182,510 | 1/1980 | Lundell | 272/93 |
| 4,185,816 | 1/1980 | Bernstein | 272/93 |
| 4,212,458 | 7/1980 | Bizilia | 272/93 |
| 4,468,022 | 8/1984 | Wu | 272/93 |

*Primary Examiner*—Richard J. Apley

*Assistant Examiner*—David J. Brown

[57] ABSTRACT

Foot holding apparatus for use in performing sit-up exercises has a pair of foot holding devices which are preferably separate and with each provided with a clamping device by which it can be secured to the bottom of a door. Each device has a convex seat against which the arch section of a foot is held by a strap overlying the instep section thereof. The seats are so dimensioned and disposed that when the feet of the user are so held and the user is lying on the floor, the ball portions and toe of both feet engage the door and the heels thereof rest on the floor with the plane inclusive of the ball portions and the hubs defining an acute angle with the floor such that the knees of the user are bent to an extent enabling abdominal muscles to be exercised with minimum risk to the lower back. In the preferred embodiment the foot holding devices are vertically adjustable relative to their clamping devices.

5 Claims, 5 Drawing Figures

FOOT HOLDING APPARATUS FOR USE IN PERFORMING SIT-UP EXERCISES

BACKGROUND REFERENCES

U.S. Pat. No. 3,134,592
U.S. Pat. No. 4,182,510
U.S. Pat. No. 4,185,816
U.S. Pat. No. 4,212,458

BACKGROUND OF THE INVENTION

One of the most common and important exercises is the performance of sit-ups in order to strengthen abdominal muscles and to maintain them in good condition.

In performing sit-up exercises, best results are attained if the feet are held down and various types of apparatus have been proposed for that purpose. Each such apparatus included either one or two foot holding devices and a device by which the apparatus could be anchored to a supporting member for which purpose a door is most suitable.

It is well established that in performing sit-up exercises, it is important that the exercising effort be confined to the abdominal muscles with stress on the lower back minimized or avoided. To achieve that result, the feet of the user must be so held that his knees will be bent.

I have found, as shown in my U.S. Pat. No. 4,212,458 that the above requirements are best satisfied if the foot is so held that a plane inclusive of its ball portion and its heel define an acute angle relative to the floor that does not appreciably exceed 60°. While apparatus in accordance with that patent enables the requirements to be met, the feet are not sufficiently immobilized to ensure maximum comfort in use nor does such apparatus permit of adjustments for foot size and their spacing which are also necessary for comfort in use.

THE PRESENT INVENTION

The general objective of the present invention is to provide that the exercising apparatus have foot holding devices that enable the feet to be securely and comfortably held during the performance of sit-up exercises.

In accordance with the invention, this objective is attained with each foot holding device provided with a seat engageable only by a major portion of the arch section of the foot which is held thereagainst by a retaining strap overlying the instep section. The devices are secured to doors by clamping devices and each foot holding device secures a foot with its ball portion and toes bearing against the door and the heel thereof resting on the floor with a plane inclusive of the ball portion and the heel defining an acute angle with the floor such that when both feet of an exerciser are so held, in use the knees of the exerciser are bent, the toes of both feet substantially fully flexed away from that plane, with the angle between each leg and foot such as to avoid or minimize leg tensioning.

In practice and as preferred, the foot holding devices are separate and each has its own device for clamping engagement with opposite sides of a door and the seats are convex. As the foot holding devices are independent, they may be spaced apart that distance the user finds preferable.

Another objective of the invention is to ensure that the apparatus enables feet of different lengths to be comfortably accommodated and held in the same manner, an objective attained by providing that each foot holding device is vertically adjustable relative to its clamping device.

PRIOR ART STATEMENT

While none of the cited patents provides foot holding devices such as are required by the present invention and as defined by the claims, U.S. Pat. No. 4,185,816 discloses a construction in which the foot holding devices are detachable from the clamping means but which do not permit of vertical adjustments of the relation of the foot holding means thereto.

In U.S. Pat. No. 4,182,510 each foot of the exerciser was held flat with respect to the floor and was held against its supporting platform by a strap overlying the ball portion thereof.

Reference is made to U.S. Pat. No. 3,134,592 only because the bar 16 is vertically adjustable.

My U.S. Pat. No. 4,212,458 as has been previously discussed, does not provide nor suggest the essential features of the foot holding devices that have been referred to.

BRIEF DESCRIPTION OF THE DRAWINGS

The accompanying drawings illustrate a preferred embodiment of the invention with FIG. 1 is a side view of one of the devices showing it clamped to a door and with a foot secured to the device.

THE PREFERRED EMBODIMENT OF THE INVENTION

Figure 1:
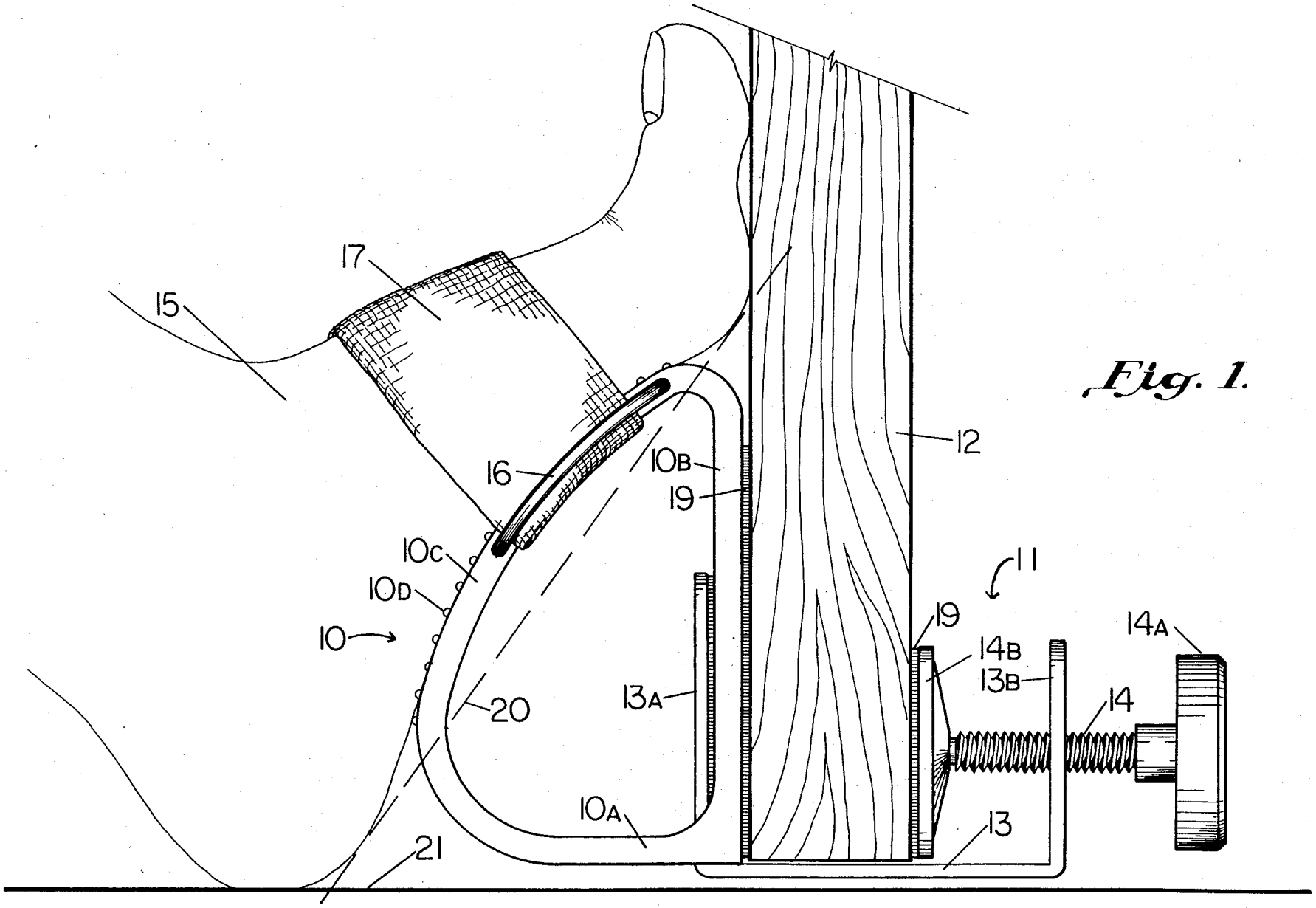
Figure 2:
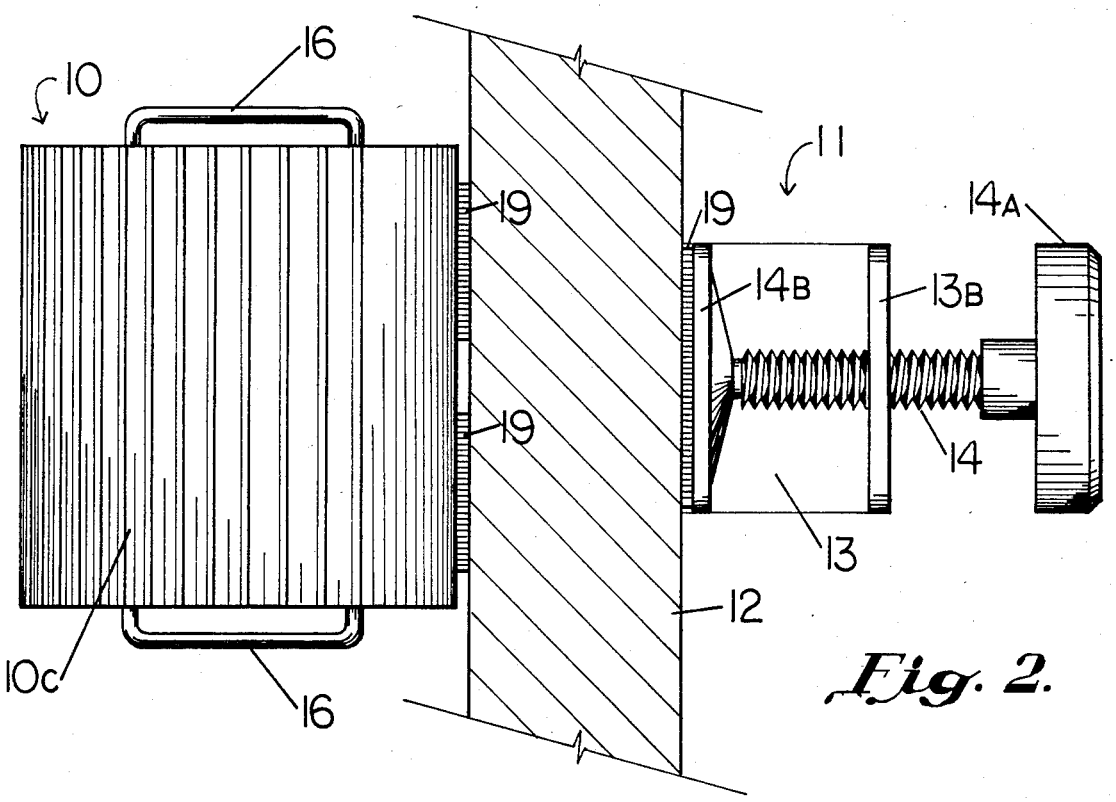
FIG. 2 is a top plan view of the device.

In the preferred embodiment of the apparatus, there are two identical units with each consisting of a foot holding device, generally indicated at 10 and a device, generally indicated at 11 for securing the device 10 in a position of use, in the disclosed embodiment with the device 11 clamped to the bottom of a door 12.

The clamping device 11 consists of a U-shaped channel 13 of a width substantially greater than the thickness of the door 12 with its side wall 13A, hereinafter sometimes called the inner wall, shown as of a height considerably greater than that of the other or outer channel wall 13B. A clamping screw 14 is threaded through the wall 13B and is of the conventional type having a knob 14A on its outer end and a clamping disc 14B carried by the other end thereof.

Each foot holding device 10 is shown as a generally tubular body having a short flat base 10A, a longer flat back 10B joined thereto at right angles and a convex foot seat 10C having curved junctions with the base and back. The seat 10C is dimensioned to extend the full length of the arch section of a foot 15 and has at each side a holder 16 establishing a slot of substantial length to slidably receive a foot retaining strap 17 which is preferably a nylon strap to which a length of Velcro is secured and the width of which is such as to overlie a substantial portion of the length of the instep section of the foot. The surface of the seat 10C is shown as provided with small, transverse and rounded ridges 10D to prevent foot slippage. A body width of three to four inches is satisfactory and it may be of any suitable plastic, either molded or extruded.

Figure 3:
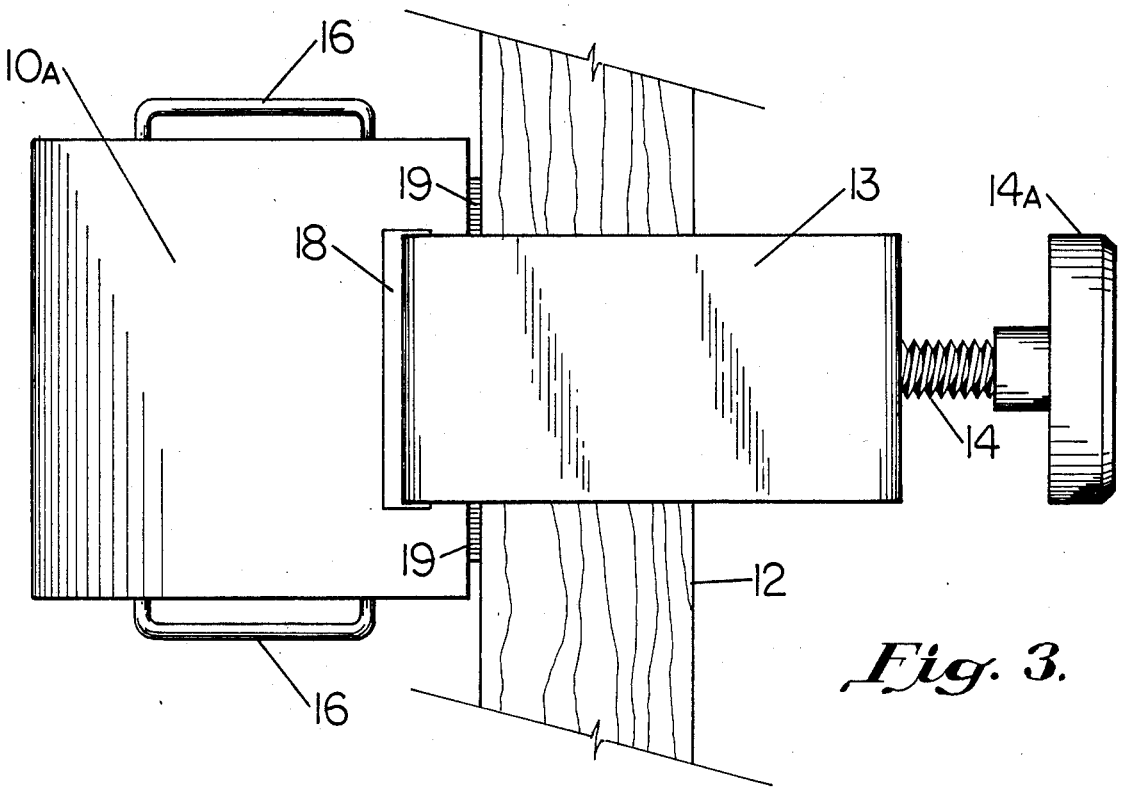
FIG. 3 is a bottom view thereof.

The base 10A of the foot holding device 10, see FIG. 3, has a transverse slot 18 at its junction with the back wall 10B dimensioned freely to receive the inner wall 13A of the channel of the device 11 and to overlie and be engageable with the back wall 10B thereby to assemble a unit. It will be noted that the door engaging surface of the back 10B and of the clamping disc 14B and the surface of the inner wall 13A that engages the back wall 10B are provided with appropriately dimensioned sections of adhesive backed rubber padding 19.

The assembled unit then may be installed for use. With the door 12 open, the channel 13 is so positioned that it may receive and be slid lengthwise of the bottom edge of the door into a selected position where it is clamped in place by means of the clamping screw 14 which also locks the back 10B against the proximate side of the door 12. Before the unit is thus secured, its foot holding unit 10 may be slid upwardly if the size of the foot 15 so requires and it will be noted that the height of the channel wall 13A is such that it provides a substantial overlapping engagement with the back wall 10B to permit such vertical adjustments.

The relative length of the base and back of the body 10 are such that a plane 20 inclusive of the ball portion of the foot 15 and the heel thereof defines with the floor 21 an acute angle in the approximate range of 55° to 60° and with the length of the seat 10C such that the toes and the ball portion of held foot 15 bear against the door 12 with the toes substantially fully flexed and the heel of the foot rests on the floor 21.

Figure 5:
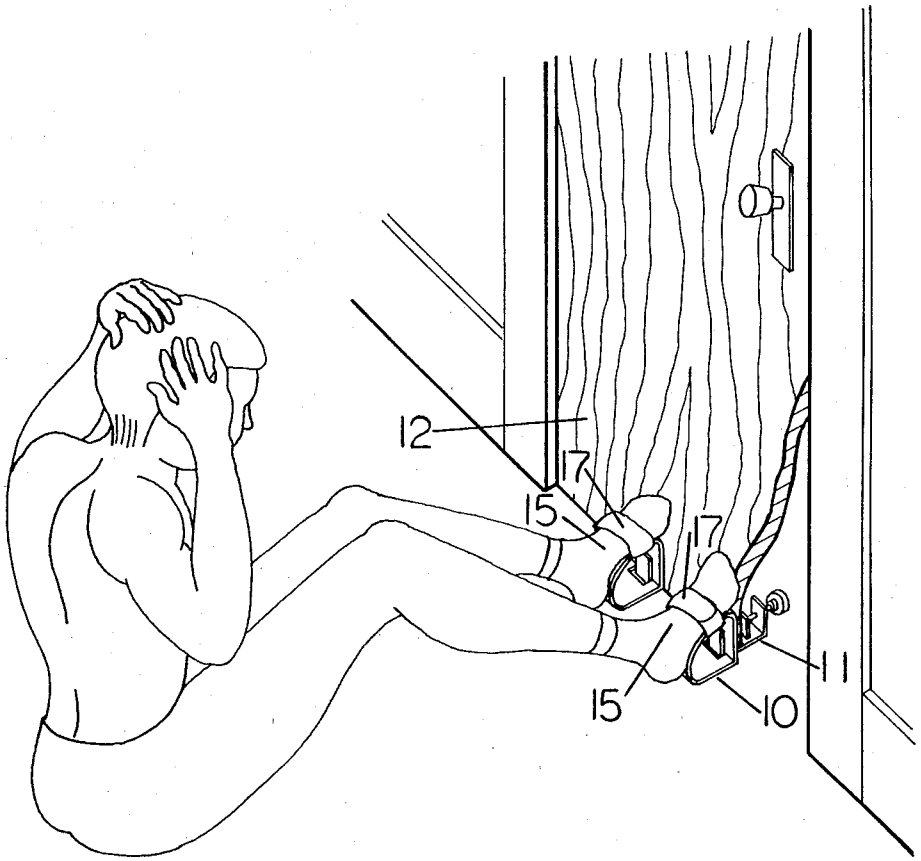
FIG. 5 is a partly sectioned perspective view with each foot held by a device and each device secured to a door illustrating a person performing sit-up exercises.
Figure 4:
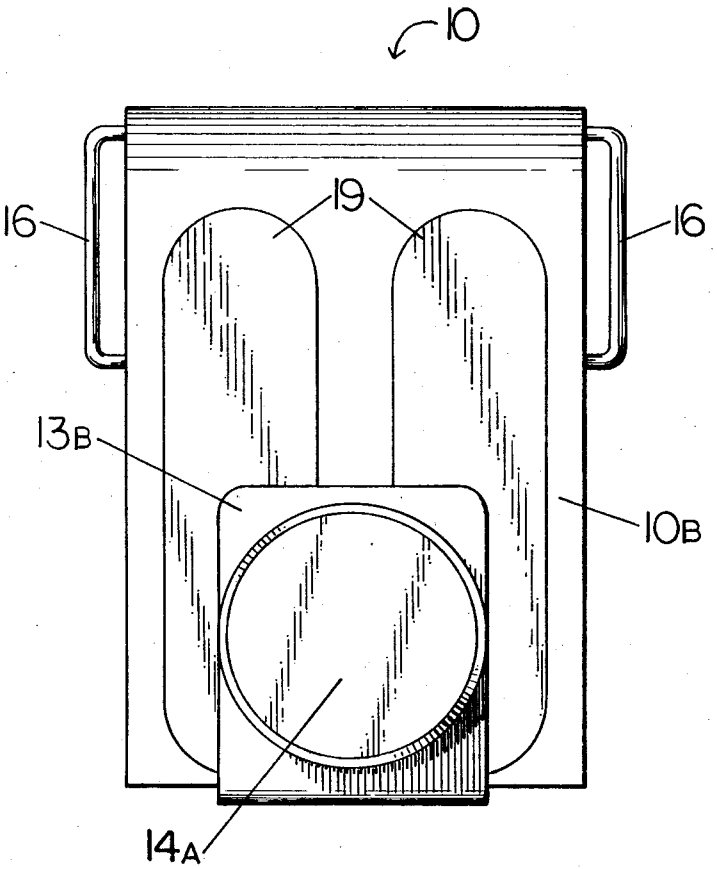
FIG. 4 is a view of the device as seen from the rear.

In practice and as is illustrated by FIG. 5, the two units are secured to the door 12 in spaced apart positions such that the arch of each foot is engaged and comfortably supported. During exercising, the user is in a position such that the knees are bent and the angle between each leg and its foot such that the leg muscles are not stressed, preferably with each leg disposed at an angle close to 90° with respect to the plane 20. Sit-up exercises can then be performed that ensure that the abdominal muscles can be effectively exercised with minimum stress in the lower back.

I claim:

1. A device for use in performing sit-up exercises with the user lying on the floor adjacent to and at right angles to a door, said device including a first part provided with a forwardly disposed convex seat for lengthwise engagement by a substantial lengthwise portion of foot between but not including the ball and heel thereof and a rear wall engageable with a side of the door and disposed at an acute angle with reference to said seat, said first part also including means to overlie the instep of the foot and releasably hold said foot portion against the seat, and a second part attachable to the door, said second part including a front wall positionable in front of the rear wall of the first part, means operable to clamp the front wall of said second part and the rear wall of the first part against one side of the door and then holding said first part against movement relative thereto, said seat then disposed with its upper end close to the door and inclined forwardly and downwardly with its lower end close to the floor, the length of the seat and the spacing of its ends relative to the door and floor such that when said foot portion is secured to said seat, the ball portion of the foot and the toes thereof bear against the door and the heel thereof rests on the floor with the foot held substantially immovable during exercising.

2. A device for use in performing sit-up exercises with the user lying on the floor adjacent to and at right angles to a door, said device including a tubular first part provided with a forwardly disposed convex seat for lengthwise engagement by a substantial portion of a foot between but not including the ball and the heel thereof and having flat rear and bottom walls disposed at right angles to each other, the rear wall engageable with a side of the door and longer than the bottom wall, said seat having rounded junctions with said walls, said first part also including means to overlie the instep of the foot and releasably hold said foot portion against the seat, and a second part attachable to the door, means connecting said second part to said first part rearwardly of said seat and then holding said first part against movement relative thereto, said seat then disposed with its upper end close to the door and inclined forwardly and downwardly with its lower end close but spaced from the floor, the length of the seat and the spacing of its ends relative to the door and floor such that when said foot portion is secured to said seat, the ball portion of the foot bears against the door and the heel thereof rests on the floor with the foot held substantially immovable during exercising.

3. The device of claim 2 in which the second part includes a U-shaped channel having walls spaced and dimensioned to receive the bottom margin of the door freely between them, the junction between the bottom and rear wall of the first part has a port dimensioned and located to enable one channel wall to be entered freely upwardly therethrough and into the first part and engage the rear wall thereof, and means carried by the other channel wall operable to effect the clamping of the rear wall of the first part against the door by said one channel wall.

4. The device of claim 3 in which said one channel wall is of sufficient height to so overlap the rear wall of the first part as to enable the first part to be raised to a predetermined extent without loss of clamping contact.

5. The device of claim 2 in which the seat of the first part has a holder at each side and the overlying means is a strip of Velcro covered strap of substantial length underlying the seat with its end extending upwardly through the holder.

* * * * *